US005553751A

United States Patent [19]

Mowers

[11] Patent Number: 5,553,751

[45] Date of Patent: Sep. 10, 1996

[54] WATER DISPENSER

[75] Inventor: Doug Mowers, Worcester, N.Y.

[73] Assignee: Mountainside Springs Corporation, Worcester, N.Y.

[21] Appl. No.: 289,416

[22] Filed: Aug. 12, 1994

[51] Int. Cl.[6] ..... B67D 5/06

[52] U.S. Cl. ..... 222/183; 222/185.1

[58] Field of Search ..... 222/146, 183, 222/185.1, 146.6, 131; 62/390, 395, 397; 141/18, 82, 364

[56] References Cited

U.S. PATENT DOCUMENTS

| | | | |
|---|---|---|---|
| D. 87,616 | 6/1932 | Blaich | D7/304 |
| D. 106,030 | 6/1937 | Gibson | D7/306 |
| D. 251,299 | 3/1979 | Neel | D15/118 |
| D. 341,746 | 11/1993 | Stillson | D7/306 |
| 752,546 | 2/1904 | Harris et al. | 62/340 |
| 2,490,379 | 10/1945 | Schlumbohn | 62/149 |
| 3,179,292 | 4/1965 | Terry | 222/52 |
| 3,269,143 | 8/1966 | Gasparovich | 62/389 |
| 3,363,432 | 8/1966 | Sholtes | 62/397 |
| 3,824,801 | 7/1974 | Laudato, Jr. | 62/397 |
| 4,293,082 | 10/1981 | Matsueda | 222/185 |
| 4,557,399 | 12/1985 | Redick, Jr. | 222/183 |
| 4,779,426 | 10/1988 | Desrosiers | 62/340 |
| 4,834,267 | 5/1989 | Schroer et al. | 222/185 |
| 5,184,476 | 2/1993 | Desrosiers et al. | 62/389 |
| 5,356,046 | 10/1994 | Burke | 222/183 |

*Primary Examiner*—Andres Kashnikow
*Assistant Examiner*—Philippe Derakshani
*Attorney, Agent, or Firm*—Schmeiser, Olsen & Watts

[57] ABSTRACT

A water dispenser is disclosed which includes a base having an upper surface, a lower surface, an outer surface, and an inner surface. The base includes a surface molding disposed on the upper surface and a well disposed inside said base for holding fluid. A plurality of dispensers are on the base for dispensing fluid from the well. A cap having a skirt on a lower periphery is placed on the base. The surface molding and skirt provide protection for a wood veneer finish on the water dispenser.

5 Claims, 4 Drawing Sheets

FIG. 5
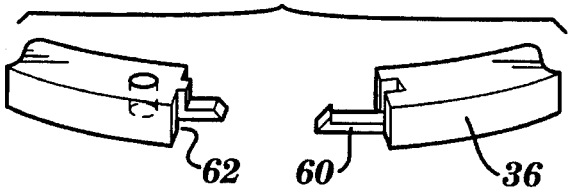
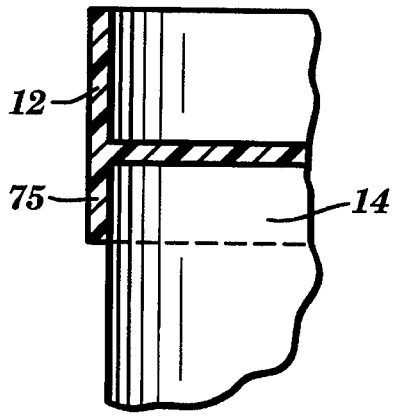
FIG. 6
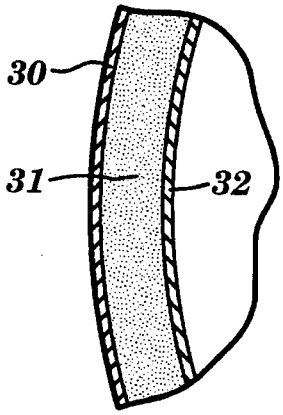
FIG. 4
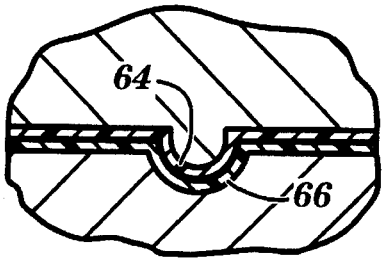
FIG. 7
FIG. 8
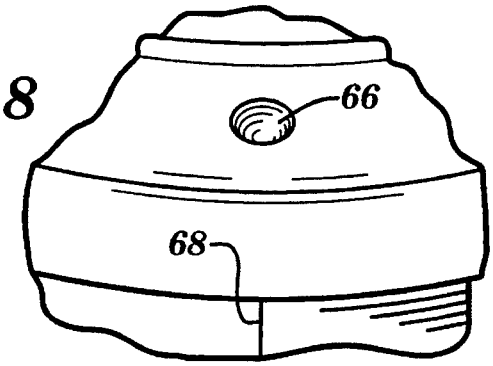

WATER DISPENSER

FIELD OF THE INVENTION

The present invention relates generally to water dispensers. In particular, the present invention is concerned with a wooden water dispenser for dispensing hot and cold water from a bottled water container.

BACKGROUND OF THE INVENTION

Heretofore, water dispensers have been provided for dispensing water in various manners from bottled water containers. In U.S. Pat. No. 4,779,426 to Desrosiers a water dispenser with a one-piece removable well is disclosed. The bottled water container is concealed inside an upper part of a water dispenser and the well of the cooler is molded as a single piece such that it may easily be removed for cleaning and servicing.

Another water dispenser which uses inverted bottled water is U.S. Pat. No. 3,363,432 to Sholtes. Sholtes discloses a water dispenser which has a hinged condenser to allow access to the interior of the cabinet through the open rear face. U.S. Pat. No. Des. 251,299 to Neel discloses a bottled water cooler stand. Other Design Patents include U.S. Pat. No. Des. 106,030 to Gibson, U.S. Pat. No. Des. 341,746 to Stillson, and U.S. Pat. No. Des. 87,616 to Blaich.

U.S. Pat. No. 3,779,292 to Terry discloses a water dispenser which comprises an upright cabinet having a top and three upstanding sides defining one open side in the cabinet. A shelf is provided within the cabinet and supported from the shelf is a water cooling reservoir into which water to be cooled is pumped from containers supported by a low wheeled support frame.

U.S. Pat. No. 752,546 to Harris et al. discloses a combined refrigerator and soda-water fountain.

U.S. Pat. No. 2,490,379 to Schlumbohm discloses an apparatus for improving the taste of cold liquids and for mixing liquids. More specifically,, the invention aims at improving the taste of ice water and of cocktails.

U.S. Pat. No. 3,269,143 to Gasparovich relates to liquid cooling units in which a liquid supply bottle is positioned in the bottom of the unit and remains in an upright position.

U.S. Pat. No. 5,184,476 to Desrosiers et al. discloses a counter-height water dispenser having a removable connectable faucet and low-pressure joints whereby water is dispensed at low-pressure.

The above prior art summaries are merely representative of portions of the inventions disclosed in each reference. In no instance should these summaries substitute for a thorough reading of each individual reference.

SUMMARY OF THE INVENTION

The present invention is a wooden water dispenser. The wooden water dispenser includes a cap and a base. The cap and base are formed using a veneer type finish laminated to paper board having an inner sealant applied thereto. A bottle of inverted water is inserted into the base and the cap is placed thereover. The cap and base are connected together by a cap skirt and a base surface molding respectively. The cap skirt and the base surface molding help protect the veneer finish of the cap and base from water damage, chipping, or splintering.

BRIEF DESCRIPTION OF THE DRAWINGS

These and other advantages of the present invention will become more readily apparent upon reading the following detailed description and upon reference to the drawings in which:

FIG. 4 is a cutaway cross sectional view of the water dispenser of the present invention;

FIG. 5 is a partial view of the cap skirt of the present invention;

FIG. 6 is a partial cutaway view of the cap of the present invention;

FIG. 7 is a view of the connection between the cap skirt and the base surface molding of the present invention.

FIG. 8 is a view of the base surface molding of the present invention.

DETAILED DESCRIPTION OF THE PREFERRED EMBODIMENTS

Figure 1:
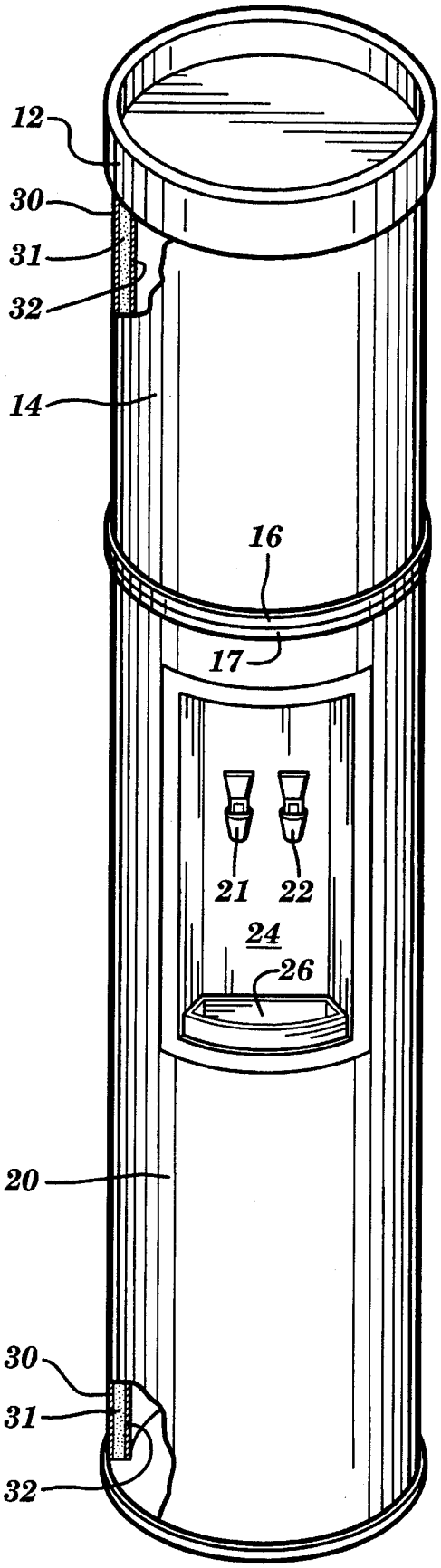
FIG. 1 is a front perspective view of the water dispenser of the present invention.

Referring now to the drawings, and more particularly to FIG. 1, there is shown generally at 10 a water dispenser of the present invention which includes a planter cap 12 positioned on cap 14. Cap 14 is constructed from an outer layer of a wood veneer 30 which is laminated to CONTOUR TUBE®, a paper board tube 31. On an inner surface of the paperboard is a sealant 32 to protect the tube from moisture. Although the cooler is disclosed as being cylindrical, other shapes are also contemplated such as a box or a solid having a hexagonal cross-section. The base 20 is also constructed of a wood veneer and paperboard laminate having sealant 32 thereon.

At the lower periphery of the cap 14 is a cap skirt 16. The cap skirt 16 mates with a base surface molding 17. The base 20 also includes a dispensing recess 24 having a hot water dispenser 21 and a cold water dispenser 22 thereon. At the bottom of the dispensing recess 24 is a drip pan 26.

Figure 2:
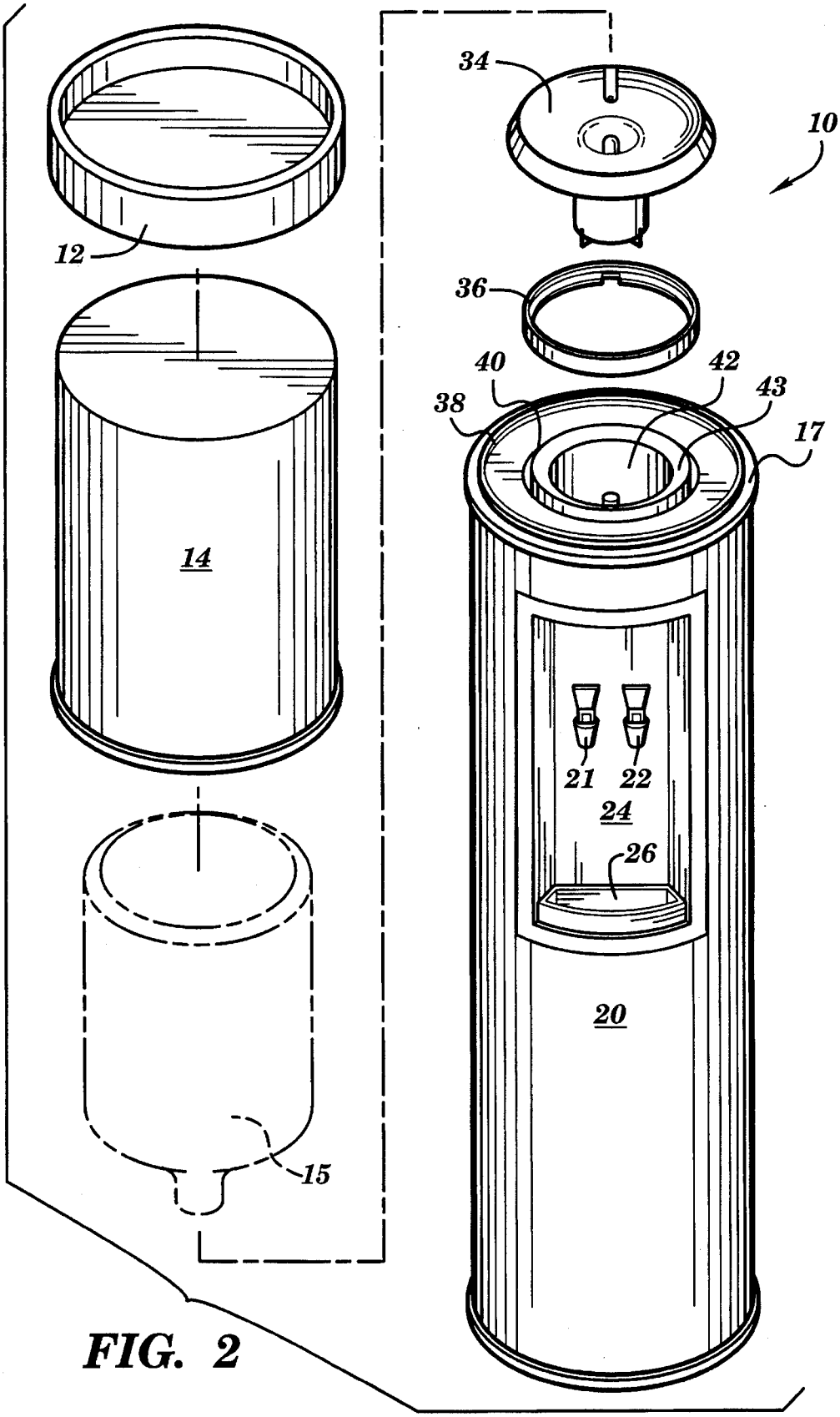
FIG. 2 is an exploded perspective view of the water dispenser of the present invention.

Referring to FIG. 2 is an exploded view of the water dispenser 10 of the present invention. A planter cap 12 is placed over the wood veneer 30 of cap 14. The planter cap 12 is formed from a waterproof material such as plastic, an elastomer, or the like for protecting the wood veneer 30 from chipping and from warping, caused by moisture spillage by plants, or other containers such as drinking cups which may be placed on top of the water cooler. The cap 14 fits securely over an inverted water bottle 15 which is placed into water bottle engagement surface 34 of the base 20. The base 20 includes a surface molding 17 having an outer annular retaining ridge 38 and an inner annular retaining ridge 40. Inside an inner periphery of the surface molding 17 is a cold water well 42 for holding fluid therein. The cold water well 42 has a well ring 43 positioned on an upper lip of the well 42. In a prefered embodiment the well 42 is metallic and the well ring 43 formed from plastic. Over the well ring 43 and inner annular retaining ridge 40 is positioned an annular sealing ring 36. The annular sealing ring 36 prevents moisture from seeping onto the wood veneer 30 and paperboard 31 inside of the base 20.

Figure 3:
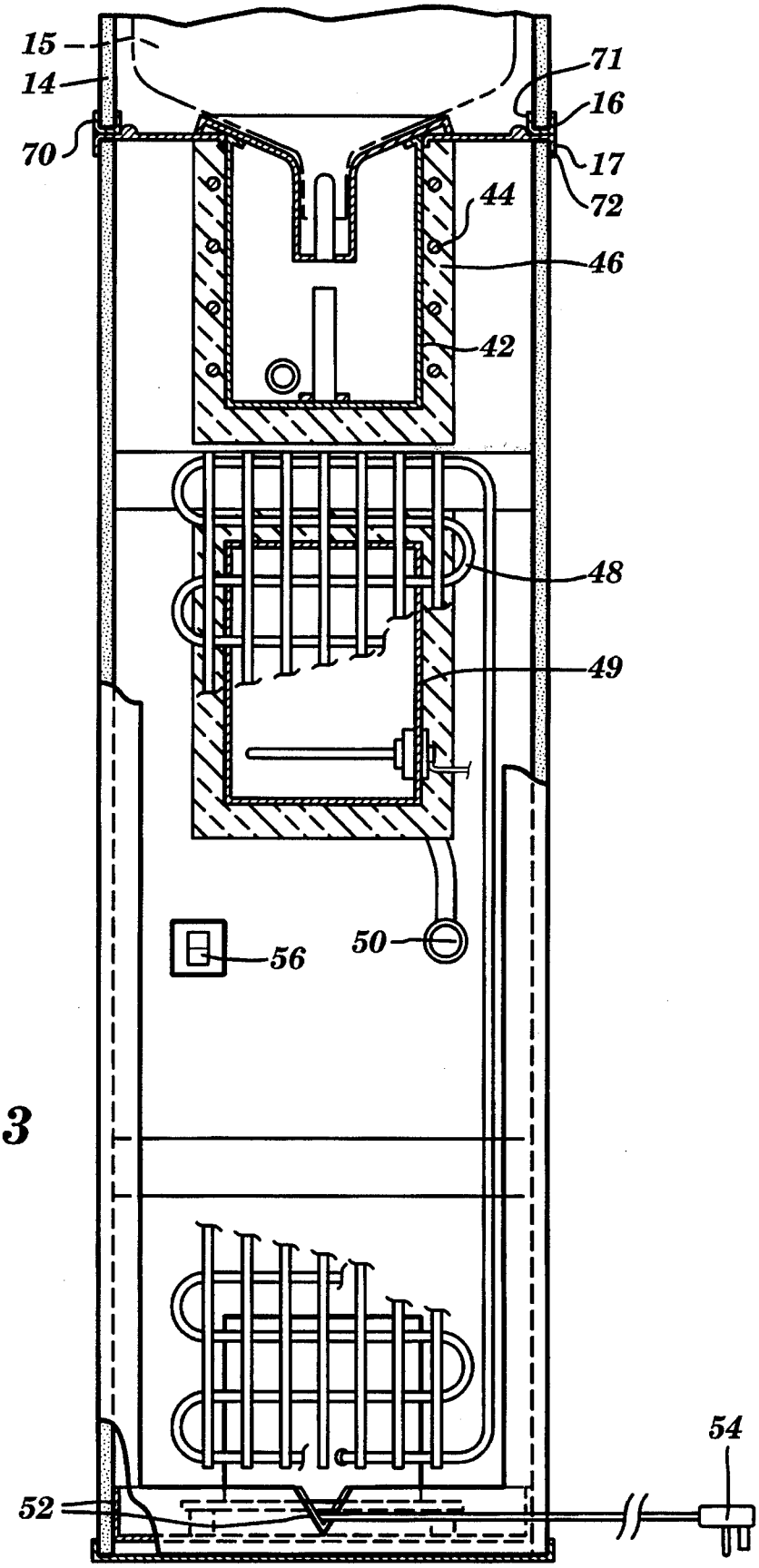
FIG. 3 is a partial cutaway view of the water dispenser of the present invention as seen from the back.

Referring to FIG. 3, after the water bottle 15 is inverted into the removable water bottle engagement surface 34, water flows from the bottle 15 and fills the well 42. The well 42 is surrounded by insulation 46 having coolant coils 44 embedded therein. Positioned below the well 42 is a insulated heating vessel 49. The heating vessel includes a heat exchanger 48 and a drain pipe 50. The water dispenser is plugged into an electrical outlet with plug 54 and turned on by switch 56. Disposed on the bottom of the base 20 is a plastic insert 52. The plastic insert prevents deterioration of the bottom of the base 20.

FIG. 4 illustrates a cross sectional view of the cap and base of the water cooler 10. On an outer layer is a wood veneer finish 30 which is laminated to a paperboard tube 31 having a sealer 32 on an inner surface thereof. One aspect of the invention is to prevent any moisture from warping the veneer and paperboard. Thus, during use various features of the invention have been incorporated to protect the finish such as the cap skirt 16 as shown in FIG. 3 having an exterior lip 70 and an interior lip 71. The annular seal ring 36 and base surface molding 17 also protect the wood finish on the water cooler. The annular base surface molding 17 also includes a lip 72 which along with lip 71 on the cap skirt 16 protects the wood veneer 30 from chipping. On an inner surface of the cap skirt 16 is a lip 71 for engaging an inner surface of the cap 14.

Optionally, planter cap 12, may be inserted over a top of the water dispenser 10. The planter cap 12 includes a lip 75 which inserts over the cap 14 for retention of the cap 12 and protection of the wood veneer 30 from chipping or water damage, such as warping.

FIG. 5 shows a snap connector having a male snap 60 and a female snap 62 on the annular sealing ring 36. The annular sealing ring 36 fits over a crevice between the inner annular retaining ring ridge 40 and the well ring 43.

With reference to FIG. 8, since the outer surface of the cap 14 and base 20 are made from wood veneer 30 they both have seam 68. In order to align the seam 68 of the base 20 and with the seam of the cap (not shown) a recess 66 and protuberance 64 are provided. The cap 14 is inserted onto the base 20 and slid in a circular manner until the protuberance 64 engages with the recess 66.

The embodiments disclosed herein have been discussed for the purpose of familiarizing the reader with the novel aspects of the invention. Although preferred embodiments of the invention have been shown, many changes, modifications and substitutions may be made by one having ordinary skill in the art without necessarily departing from the spirit and scope of the invention as described in the following claims.

I claim:

1. A water dispenser comprising:

a base formed from a first material construction susceptible to water damage and having an upper surface, a lower surface, an outer surface and an inner surface, said base including a surface molding, formed from a second material construction, disposed on said upper surface and having a lip on an outer periphery extending exterior said base outer surface for protecting said first material construction of said base;

a well disposed inside said base for holding fluid;

a dispenser disposed on said base for dispensing fluid from said well;

a cap having an upper surface, a lower surface, an inner surface and an outer surface, said cap including a skirt disposed on said lower surface, whereby said skirt is engagable with said surface molding of said base when said cap is positioned on said base.

2. The water dispenser of claim 1, wherein the surface molding includes an inner retaining ridge and an outer retaining ridge, whereby an interior lip of said skirt is adapted to engage said outer retaining ridge when said cap is placed on said base.

3. The water dispenser of claim 2, further comprising a seal disposed proximate said inner retaining ridge and said well to provide a seal to prevent moisture from entering said base.

4. The water dispenser of claim 1, wherein said first material construction is a wood veneer and paper board laminate.

5. The water dispenser of claim 4, wherein at least one of the skirt and the base surface molding includes a recess and the other includes a protuberance, and whereby a seam in the wood veneer of the cap may be aligned with a seam in the wood veneer of the base.

* * * * *